US006860046B1

(12) United States Patent
Squitieri

(10) Patent No.: US 6,860,046 B1
(45) Date of Patent: Mar. 1, 2005

(54) SHELF GLIDE DIVIDER GAUGE AND METHOD

(75) Inventor: Anthony C. Squitieri, Monroe, CT (US)

(73) Assignee: Mechtronics Corporation, White Plains, NY (US)

( * ) Notice: Subject to any disclaimer, the term of this patent is extended or adjusted under 35 U.S.C. 154(b) by 0 days.

(21) Appl. No.: 10/301,684

(22) Filed: Nov. 21, 2002

Related U.S. Application Data

(60) Provisional application No. 60/331,976, filed on Nov. 21, 2001.

(51) Int. Cl.[7] ..... G09F 3/10

(52) U.S. Cl. ..... 40/299.01; 33/492; 33/494

(58) Field of Search ..... 40/299.01; 33/451, 33/492, 494, 1 C, 562; 108/107, 110; 211/59.2, 74, 175, 187

(56) References Cited

U.S. PATENT DOCUMENTS

| | | | | | |
|---|---|---|---|---|---|
| 1,380,187 | A | * | 5/1921 | Brose | 33/562 |
| 1,827,375 | A | * | 10/1931 | Schneider | 33/562 |
| 2,579,664 | A | * | 12/1951 | Gleasman | 33/492 |
| 3,006,314 | A | * | 10/1961 | Malec | 33/717 |
| 3,416,485 | A | * | 12/1968 | Phillips | 33/494 |
| 4,445,370 | A | * | 5/1984 | Whitmire | 33/723 |
| 5,351,838 | A | * | 10/1994 | Flum | 211/59.2 |
| 5,487,223 | A | * | 1/1996 | Krane | 33/494 |
| 5,624,042 | A | * | 4/1997 | Flum et al. | 211/59.2 |
| 5,706,956 | A | * | 1/1998 | Headrick et al. | 211/59.2 |
| 6,305,093 | B1 | * | 10/2001 | Venola | 33/492 |
| 6,389,993 | B1 | * | 5/2002 | Ondrasik | 108/107 |

* cited by examiner

*Primary Examiner*—Lars A. Olson
(74) *Attorney, Agent, or Firm*—Wiggin and Dana LLP

(57) ABSTRACT

A gauge is provided for positioning divider walls in a beverage glide and has an origin indicia and a plurality of text indicia associated with different beverage container sizes.

20 Claims, 4 Drawing Sheets

SHELF GLIDE DIVIDER GAUGE AND METHOD

CROSS REFERENCE TO RELATED DOCUMENTS

Priority is herewith claimed under 35 U.S.C. §119(e) from copending U.S. Provisional Patent Application No. 60/331,976, filed Nov. 21, 2001, entitled "SHELF GLIDE DIVIDER GAUGE AND METHOD," by Anthony C. Squitieri. The disclosure of this U.S. Provisional Patent Application is incorporated by reference herein in its entirety.

BACKGROUND OF THE INVENTION (1) Field of the Invention

This invention relates to glides, and more particularly to retail display glides for holding a number of beverage containers.

(2) Description of the Related Art

My PCT International Application PCT/US00/33248, entitled "GLIDE," filed Dec. 8, 2000, the disclosure of which is incorporated by reference in its entirety herein as if set forth at length, discloses an exemplary beverage glide for holding a variety of sizes of cans, bottles, and the like. An aspect of the glide is the adjustable pitch between divider walls defining lanes for individual containers.

BRIEF SUMMARY OF THE INVENTION

A gauge is provided for positioning divider walls in a beverage glide. The gauge has an origin indicia and a plurality of second indicia associated with different beverage container sizes.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements. Exemplary dimensions are shown in inches.

DETAILED DESCRIPTION OF THE PREFERRED EMBODIMENTS

Figure 1:
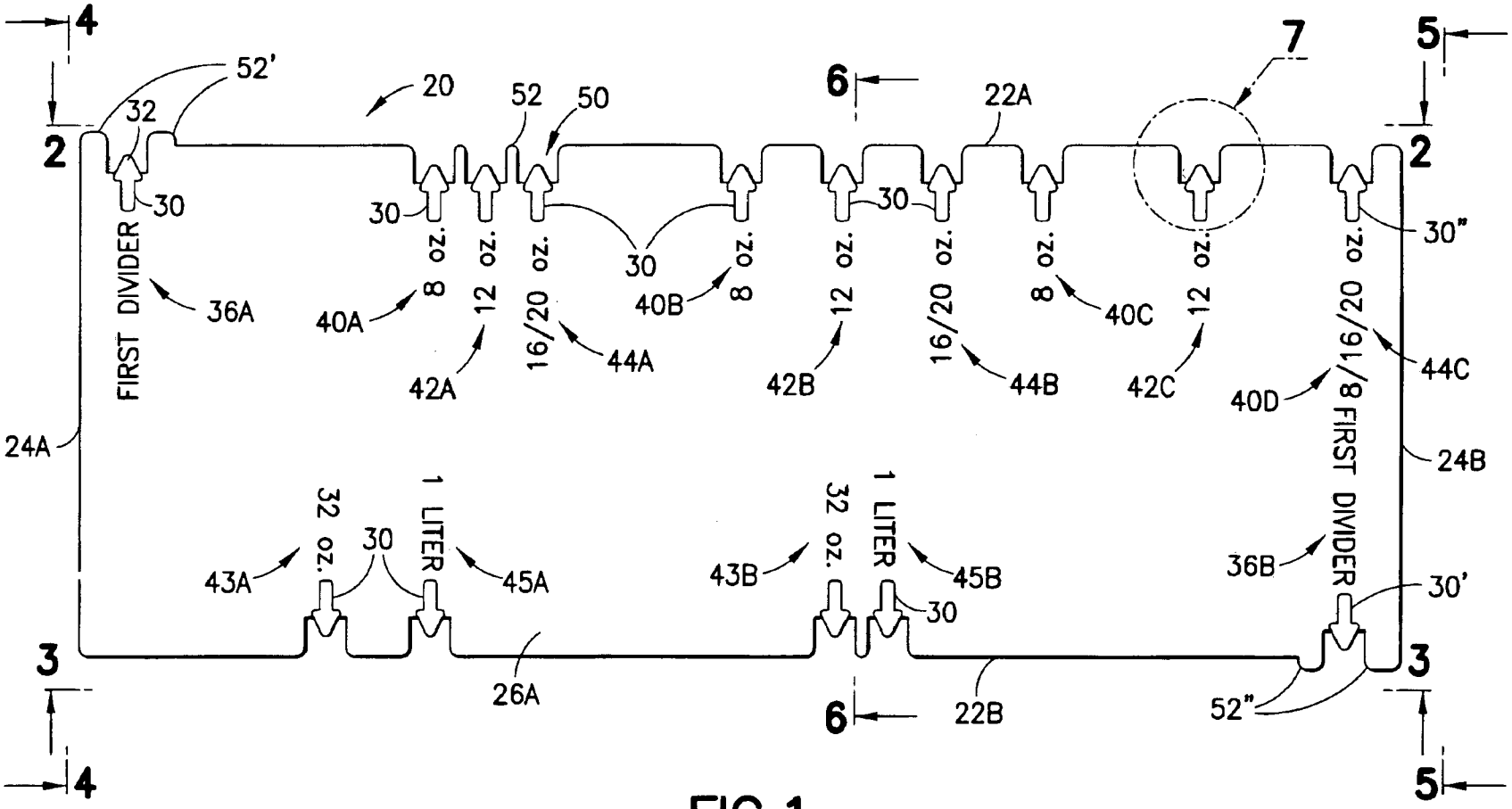
FIG. 1 is a top plan view of a gauge constructed in accordance with one embodiment of the present invention.
Figure 2:
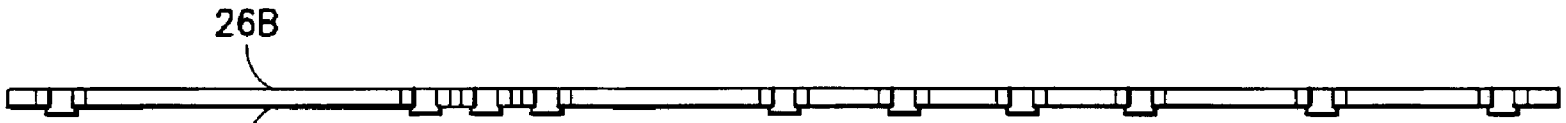
FIG. 2 is a first side view of the gauge of FIG. 1.
Figure 3:
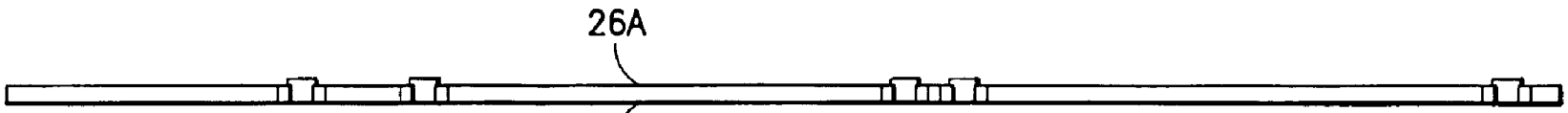
FIG. 3 is a second side view of the gauge of FIG. 1.
Figure 7:
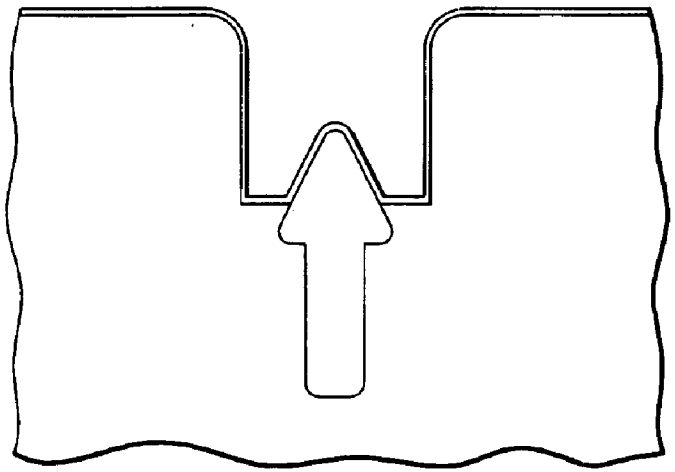
FIG. 7 is a detailed view of a registration feature of the gauge of FIG. 1.
Figure 4:
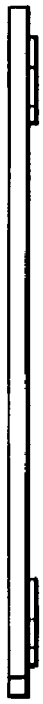
FIG. 4 is a first end view of the gauge of FIG. 1.
Figure 5:
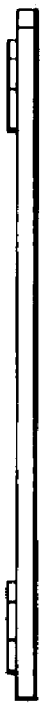
FIG. 5 is a second end view of the gauge of FIG. 1.
Figure 6:
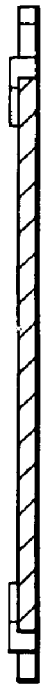
FIG. 6 is a sectional view of the gauge of FIG. 1.

FIG. 1 shows a gauge 20 formed, for example, as a unitary one-piece plastic molding (e.g., of polystyrene). The exemplary gauge is generally flat and elongate in nature having first and second edges 22A and 22B and first and second ends 24A and 24B. The exemplary gauge also has two generally flat surfaces 26A and 26B (FIG. 2). In the exemplary embodiment, the first surface 26A is an upper surface and includes various protruding indicia described below formed, for example, in an injection molding process, whereas the second surface 26B is a lower surface and is substantially entirely flat.

The exemplary indicia include registration marks which, in the exemplary embodiment, are formed as arrows 30 molded in the gauge and having outwardly-directed tip portions 32. The indicia also include text. Along each edge, a first text indicia proximate one extreme of the edge is an origin or "first divider" indicia 36A, 36B inboard of a stem of an associated arrow 30'. Second text indicia (40A–40D, 42A–42C, 43A–43B, 44A–44C, and 45A–45B), along the edges 22A and 22B identify specific sizes of beverage containers by, for example, volume contained therein. In one embodiment (not shown) the second text indicia specifies container type such as, for example, can, plastic bottle, and the like.

As illustrated in FIG. 1, sets of second text indicia are disposed along the edges 22A and 22B corresponding to a container size or type. Each of the sets are spaced at a pitch associated with a diameter (or other transverse dimension) of the container. By way of example, the exemplary divider includes, along the first edge, four indicia 40A–40D associated with eight-ounce (8 oz.) bottles. The indicia 40A–40D are at substantially a single pitch relative to each other and relative to the associated origin indicia 36A and its associated registration mark 30. As illustrated in, FIG. 1, the exemplary gauge includes indicia 42A–42C associated with twelve-ounce (12 oz.) containers.

It should be appreciated that more than one container may have a given pitch. Accordingly there may be combined indicia for multiple containers associated with the same pitch. For example, indicia 44A–44C are associated with both sixteen and twenty-ounce (16 oz. and 20 oz., respectively) containers. Similarly, one given registration mark 30 may, depending on the relative pitch of the containers, be associated with text indicia for containers having different pitches, but for which a given multiple of the pitch of a first container size is equal to another multiple of the pitch of a second container size. Accordingly, by way of example, the text indicia 40D and 44C share a registration mark 30". Similar registration marks and text indicia may be associated with the second edge 22B for example for larger containers such as, for example, thirty-two ounce (32 oz.) 43A–43B and one (1) liter 45A–45B containers.

In one embodiment, illustrated in FIGS. 1–7, the tips 32 of the arrows 30 of exemplary registration marks protrude within channels 50 recessed from adjacent portions 52 of the edge 22A. The adjacent portions 52, along the majority of the gauge, are colinear. The presence of channels 50 allows for accurate positioning of glide divider walls. Accordingly, the channels 50 are advantageously of sufficient width to receive end portions of such divider walls.

In the exemplary embodiment, the registration marks 30 associated with the origin indicia 36A and 36B protrude slightly beyond colinear with the other registration marks along the associated edges 22A and 22B (as do their adjacent edge portions 52' and 52"). This location facilitates use even when the first wall, or other wall at which the origin indicia is located, is in a relatively recessed position.

The exemplary origin indicia 36A and 36B are on a left side of the gauge when viewed from a user directing the associated edge of the gauge away from him or herself toward the glide. In use, a first divider wall can be installed at the associated extreme side (e.g., the left side in the example) of the glide base. The origin indicia 36A and 36B associated with the particular containers to be supported by the glide is placed proximate the front of that divider wall so that the divider wall front edge is received in the associated channel 50. Remaining divider walls are then located proximate the one or more second text indicia (40A–40D, 42A–42C, 43A–43B, 44A–44C, and, 45A–45B) associated with the beverage container size.

If fewer lanes are desired for a given container size than are available along the edge 22A and 22B of the gauge, only the appropriate number of divider walls are installed. If more are desired, then the gauge is repositioned with the origin indicia 36A and 36B at the last installed wall and more walls may be installed and the process repeated if necessary. It also may be desired to change pitch to allow different lanes to hold different size containers. Accordingly, after completing a given number of lanes associated with a given container size, the gauge is reset to place the appropriate origin 36A and 36B at the last installed wall and the appropriate number of lanes of the next container size installed and the process repeated if necessary.

The gauge alternatively may be used from the rear of the glide. The gauge also may be used to reposition some or all dividers already installed on a glide such as to accommodate a new mix of container sizes. Additionally, the installation using the gauge may be partial (e.g., with the exemplary glide, only inserting the walls in the associated slots) or full (e.g., with the exemplary glide, further shifting the divider walls forward to lock them in place).

Figure 8:
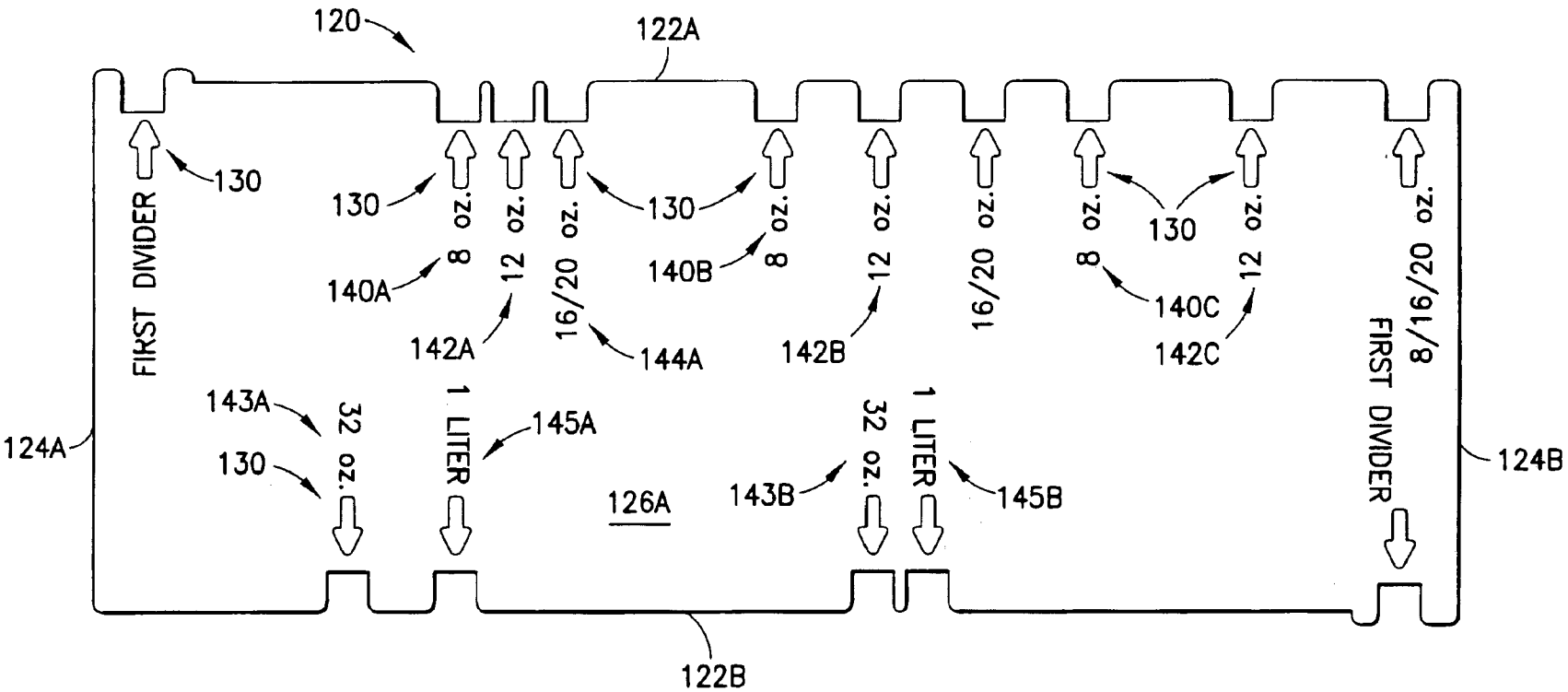
FIG. 8 is a top plan view of a gauge constructed in accordance with another embodiment of the present invention.

FIG. 8 illustrates a gauge 120 constructed in accordance with another embodiment of the present invention. The gauge 120 is formed, for example, as a unitary one piece plastic molding (e.g., of polystyrene). The gauge 120 is generally flat and elongate in nature having first and second edges 122A and 122B and first and second ends 124A and 124B. Additionally, the gauge has two generally flat surfaces 126A and 126B (not shown). In accordance with the present invention, the first surface 126A includes indicia 130 and 136 described below and, as with the second surface 126B is substantially entirely flat. In one embodiment, the indicia 130 and 136 is applied by hot stamping the surface 126A. In another embodiment, the indicia 130 and 136 is applied by silk screening the surface 126A. As such, there are substantially no protruding portions of the surface 126A.

The indicia 130 and 136 include registration marks formed, for example, as arrows 130 and text. The text includes first text indicia 136A and 136B representing an origin and second text indicia (140A–140D, 142A–142C, 143A–143B, 144A–144C, and 145A–145B), along the edges 122A and 122B identify specific sizes of beverage containers. It should be appreciated that use of gauge 120 is substantially similar to use of gauge 20 described in detail above. Differences in the gauges 20 and 120 being in the formation of indicia on surfaces 26A and 126A, respectively.

One or more embodiments of the present invention have been described. Nevertheless, it should be understood that various modifications may be made without departing from the spirit and scope of the invention. Accordingly, other embodiments are within the scope of the following claims.

What is claimed is:

1. A device comprising:

an elongate body having at least a first edge and first and second opposite sides; and a plurality of indicia visible from at least the first side, said indicia including:

at least a first origin indicia; and for each of at least a first plurality of container volumes, at least one volume indicating indicia;

wherein said at least one volume indicating indicia is spaced apart from said first origin indicia at a pitch associated with a container of said first plurality of container volumes, said pitch being of sufficient width to receive a diameter of said container.

2. The device of claim 1 wherein:

there is a second edge opposite the first edge;

said first origin indicia and said at least one volume indicating indicia are associated with the first edge; and the indicia further include:

a second origin indicia associated with the second edge; and for each of at least a one additional container volume, at least one additional volume indicating indicia associated with the second edge;

wherein said at least one additionally volume indicating indicia is spaced apart from said second origin indicia at a pitch associated with a second container of said one addition container volume, said pitch being of sufficient width to receive a diameter of said second container.

3. The device of claim 1 wherein the indicia are protrusions, protruding from the first side.

4. The device of claim 1 wherein the indicia are silk screened on the first side.

5. The device of claim 1 consisting essentially of a one-piece molding of polymer.

6. The device of claim 5 wherein said molding is of polystyrene.

7. The device of claim 1 wherein said at least one volume indicating indicia are associated with registration marks.

8. The device of claim 7 wherein at least one registration mark is associated with at least one of the volume indicating indicia of at least two of the first plurality of container volumes.

9. The device of claim 1 wherein the first origin indicia is aligned with a channel in the first edge.

10. The device of claim 1 wherein said indicia include text corresponding to a size or type of said container.

11. The device of claim 10 wherein said text is representative of at least one of an eight ounce bottle, a twelve ounce bottle, a sixteen ounce bottle, a twenty ounce bottle, a thirty-two ounce bottle and a one liter bottle.

12. A device comprising:

an elongate body having at least a first edge and first and second opposite sides; and a plurality of indicia visible from at least the first side, said indicia including:

at least a first origin indicia; and for each of at least a first plurality of container volumes, at least one volume indicating indicia;

wherein the indicia comprise an arrow having a head protruding within a channel in the first edge.

13. A method for installing divider walls in a beverage glide comprising:

aligning a first indicia on a gauge with a first divider wall;

aligning at least one second divider wall with at least one associated second indicia on the gauge identifying first beverage container volume and at least partially installing said at least one second divider wall to a base;

repositioning the gauge to align the first indicia with a last installed second divider wall; and aligning at least one third divider wall with at least one associated third indicia on the gauge identifying a second beverage container volume and at least partially installing said at least one third divider wall to the base.

14. The method of claim 13 wherein said aligning the first indicia comprises locating one end of the first divider wall within a channel in an edge of the gauge associated with the first indicia.

15. The method of claim 13 wherein prior to said repositioning, the method further comprises:

repositioning the gauge to align the first indicia with a last installed such second divider wall; and aligning at least one additional second divider wall with at least one associated such second indicia identifying said first container volume and at least partially installing said at least one additional second divider wall to the base.

16. The method of claim 13 wherein said first indicia is a first origin indicia and wherein the method further comprises:

repositioning the gauge to align a second origin indicia with a last installed divider wall; and aligning at least one third divider wall with at least one associated third indicia on the gauge identifying a third beverage container volume and at least partially installing said at least one third divider wall to the base.

17. A device comprising:

an elongate body having a side and an edge; and a plurality of indicia visible on said side, said indicia including:

an origin indicia; and for each of a plurality of container volumes, a plurality of volume indicating indicia, wherein said volume indicating indicia includes:

first volume indicating indicia spaced apart from said origin indicia at a first pitch associated with a first container of a first volume of said plurality of container volumes, said first pitch being of sufficient width to receive a diameter of said first container; and second volume indicating indicia spaced apart from said origin indicia at a second pitch associated with a second container of a send volume of said plurality of container volumes, said pitch being of sufficient width to receive a diameter of said second container, and said second volume being different from said first volume.

18. The device of claim 17 wherein said volume indicating indicia further includes additional ones of said first volume indicating indicia spaced apart from said origin indicia at a multiple of said first pitch.

19. The device of claim 17 wherein said volume indicating indicia further includes additional ones of said second volume indicating indicia spaced apart from said origin indicia at a multiple of said second pitch.

20. The device of claim 17 wherein said origin indicia and each of said plurality of volume indicating indicia is aligned with a channel in said edge.

* * * * *